US008807708B2

(12) United States Patent
Fujii

(10) Patent No.: US 8,807,708 B2
(45) **Date of Patent: *Aug. 19, 2014**

(54) SEMICONDUCTOR DEVICE, LIQUID DISCHARGE HEAD, LIQUID DISCHARGE CARTRIDGE, AND LIQUID DISCHARGE APPARATUS

(71) Applicant: Canon Kabushiki Kaisha, Tokyo (JP)

(72) Inventor: Kazunari Fujii, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/020,029

(22) Filed: Sep. 6, 2013

(65) Prior Publication Data

US 2014/0002549 A1 Jan. 2, 2014

Related U.S. Application Data

(63) Continuation of application No. 13/106,131, filed on May 12, 2011, now Pat. No. 8,562,111.

(30) Foreign Application Priority Data

May 28, 2010 (JP) ..... 2010-123302

(51) Int. Cl.
*B41J 2/05* (2006.01)

(52) U.S. Cl.
USPC ..... 347/58; 347/50; 347/148

(58) Field of Classification Search
USPC ..... 347/50, 58, 5, 9, 148
IPC ..... B41J 2/04548,2/33595
See application file for complete search history.

(56) References Cited

U.S. PATENT DOCUMENTS 7,125,105 B2 10/2006 Oomura
8,075,102 B2 12/2011 Hatsui et al.

(Continued)

FOREIGN PATENT DOCUMENTS

CN 1593919 A 3/2005
CN 1796125 A 7/2006

(Continued)

OTHER PUBLICATIONS

Notification of the First Office Action dated Aug. 13, 2013, in Chinese Application No. 201110134964.1.
Extended European Search Report issued in European Application No. 11164891.1 dated Jan. 16, 2014.

*Primary Examiner* — Lam S Nguyen
(74) *Attorney, Agent, or Firm* — Fitzpatrick, Cella, Harper & Scinto

(57) ABSTRACT

A semiconductor device including segments, a power supply pad and conductive patterns is provided. Each segment includes driving units for discharging a liquid. Each driving unit includes a driving circuit and an element driven by the driving circuit to apply discharging energy to the liquid. The conductive pattern includes a first conductive portion connected to the power supply pad, a second rectangular conductive portion, a third conductive portion connected to the driving portions, and a connection portion which connects the second and third conductive portions. These conductive portions elongate in a first direction. In a second direction, a length of the second conductive portion is larger than a length of the first conductive portion. The second conductive portion is connected to the first conductive portion at a first corner and the connection portion at a second corner diagonal to the first corner.

20 Claims, 9 Drawing Sheets

(56) References Cited

U.S. PATENT DOCUMENTS

| | | | | |
|---|---|---|---|---|
| 2001/0052916 | A1* | 12/2001 | Komuro | 347/58 |
| 2005/0052499 | A1* | 3/2005 | Oomura | 347/58 |
| 2007/0126798 | A1 | 6/2007 | Touge | |
| 2009/0002458 | A1 | 1/2009 | Furukawa et al. | |
| 2009/0289995 | A1 | 11/2009 | Omata et al. | |

FOREIGN PATENT DOCUMENTS

| | | | |
|---|---|---|---|
| EP | 1 080 897 | A2 | 3/2001 |
| JP | 2000-117985 | A | 4/2000 |
| JP | 2005-104142 | A | 4/2005 |

* cited by examiner

SEMICONDUCTOR DEVICE, LIQUID DISCHARGE HEAD, LIQUID DISCHARGE CARTRIDGE, AND LIQUID DISCHARGE APPARATUS

This application is a continuation of U.S. patent application Ser. No. 13/106,131, filed May 12, 2011.

BACKGROUND OF THE INVENTION

1. Field of the Invention

The present invention relates to a semiconductor device, a liquid discharge head having the semiconductor device, a liquid discharge cartridge, and a liquid discharge apparatus.

2. Description of the Related Art

A liquid discharge head which discharges a liquid from orifices is used as a printhead for an inkjet method. The inkjet method uses, for example, ink as a liquid, and controls ink discharge in accordance with a print signal to apply ink onto a printing medium such as paper. A liquid discharge apparatus having the liquid discharge head is applied as, for example, an inkjet printing apparatus. An inkjet printhead utilizing thermal energy selectively generates a bubble in a liquid by applying thermal energy generated by a heater to the liquid, and discharges an ink droplet from an orifice by the energy. Recently, the number of orifices is increasing to implement higher-speed printing. However, the resistance from the bonding pad to each heater varies greatly, making it difficult to uniformly supply power to a plurality of heaters. To solve this problem, Japanese Patent Laid-Open No. 2005-104142 discloses an arrangement in FIG. 5 in which a conductive line for supplying power to a heater is divided into a plurality of conductive lines to reduce variations of the resistances of the conductive lines. In FIG. 5, four heaters 101, four power transistors 102, and four level conversion circuits 103 form one segment. The line width is set larger for a VH line running to a segment at a position apart from the bonding pad, reducing variations of the resistances of VH lines running to respective segments. This also applies to GNDH lines running from the bonding pad to respective segments. This aims at uniformly supplying power to a plurality of heaters.

SUMMARY OF THE INVENTION

In the printhead disclosed in Japanese Patent Laid-Open No. 2005-104142, when the printhead is prolonged by increasing the number of heaters arranged on a semiconductor substrate, the division count of a conductive line connected to the power supply pad increases. The widths of lines running from the bonding pad to respective segments cumulatively increase. The wiring layout requires a large area, increasing the printhead size. One aspect of the present invention provides a technique for suppressing enlargement of the wiring area while suppressing variations of line resistances up to respective segments.

One aspect of the present invention provides a semiconductor device in which a plurality of segments are formed on a semiconductor substrate, each segment including a plurality of driving units for discharging a liquid in nozzles, each driving unit including a driving circuit and an element which is driven by the driving circuit to apply, to the liquid, energy for discharging the liquid in the nozzle, wherein the semiconductor device includes a power supply pad which receives supply of external power, and a plurality of conductive patterns which supply the power from the power supply pad to the respective segments, each of the conductive patterns includes a first conductive portion which is connected to the power supply pad and elongates in a first direction, a second rectangular conductive portion which elongates in the first direction, a third conductive portion which is connected to the plurality of driving portions, and a connection portion which connects the second conductive portion and the third conductive portion, a length of the second conductive portion in a second direction perpendicular to the first direction is larger than a length of the first conductive portion in the second direction, the second conductive portion is connected to the first conductive portion at a first corner and the connection portion at a second corner diagonal to the first corner, and the third conductive portion elongates from a portion connected to the connection portion in the first direction.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

Embodiments of the present invention will now be described with reference to the accompanying drawings.

First Embodiment

Figure 1:
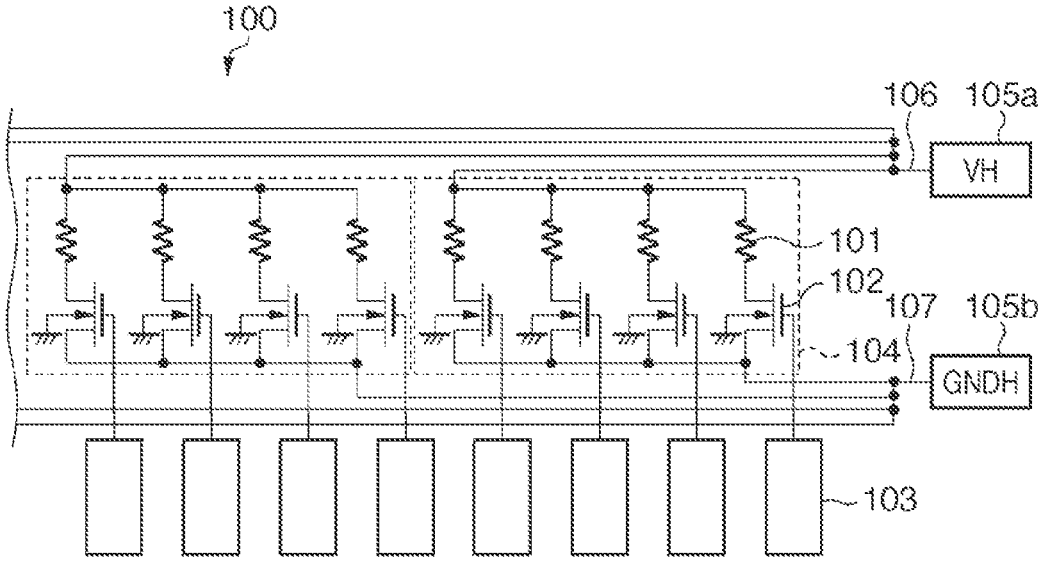
FIG. 1 is a circuit diagram showing the exemplary circuit arrangement of a semiconductor device 100 according to the first embodiment.

The circuit arrangement of a semiconductor device 100 according to the first embodiment will be exemplified with reference to FIG. 1. The semiconductor device 100 can be used to control an inkjet printhead. The semiconductor substrate of the semiconductor device 100 can include a plurality of heaters 101 for applying thermal energy to ink to discharge ink serving as a liquid in nozzles within the inkjet printhead. The semiconductor substrate of the semiconductor device 100 may further include a plurality of n-type power transistors 102 as driving circuits. Each power transistor 102 is connected to a corresponding heater 101, and supplies a current to drive the heater 101. In the semiconductor device 100, the heater 101 and power transistor 102 are in one-to-one correspondence, and a pair of them forms a driving unit. A plurality of adjacent driving units form one segment. In the semiconductor device 100 of the embodiment, for example, four adjacent driving units form one segment 104.

Each segment 104 is connected to two power supply pads 105*a* and 105*b* via conductive patterns. The power supply pads 105*a* and 105*b* receive power from the outside, for example, an inkjet printing apparatus. A conductive pattern connected to one power supply pad 105*a* is called a VH line 106, whereas a conductive pattern connected to the other power supply pad 105*b* is called a GNDH line 107. In the first embodiment, the power supply pad 105*a* has a positive potential, and the power supply pad 105*b* serves as the ground. In another embodiment, the power supply pad 105*a* may serve as the ground, and the power supply pad 105*b* may have a positive potential. The VH line 106 is branched near the power supply pad 105*a*, and the respective branches extend to corresponding segments 104. In each segment 104, the VH line 106 is further branched, and the respective branches are connected to corresponding heaters 101. Similarly, the GNDH line 107 is branched near the power supply pad 105*b*, and the respective branches extend to corresponding segments 104. In each segment 104, the GNDH line 107 is further branched, and the respective branches are connected to corresponding power transistors 102.

One end of the heater 101 is connected to the VH line 106, and the other end is connected to the source or drain of the power transistor 102. Either of the source and drain of the power transistor 102 that is not connected to the heater 101 is connected to the GNDH line 107. The gate electrode of the power transistor is connected to a logic circuit 103. The logic circuit 103 can control driving of the power transistor 102 in accordance with an external signal (not shown). The logic circuit 103 may adopt a conventional circuit arrangement, so a description of the detailed circuit arrangement will be omitted.

Figure 2A:
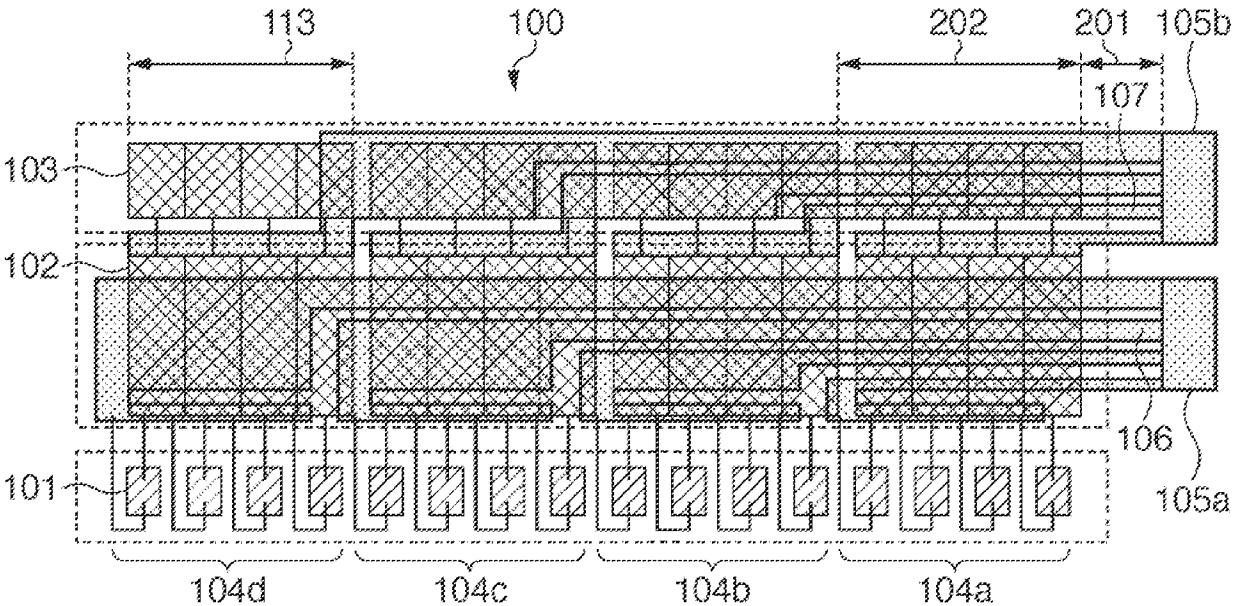
FIGS. 2A to 2C are views showing the exemplary wiring layout of the semiconductor device 100 according to the first embodiment.
Figure 2B:
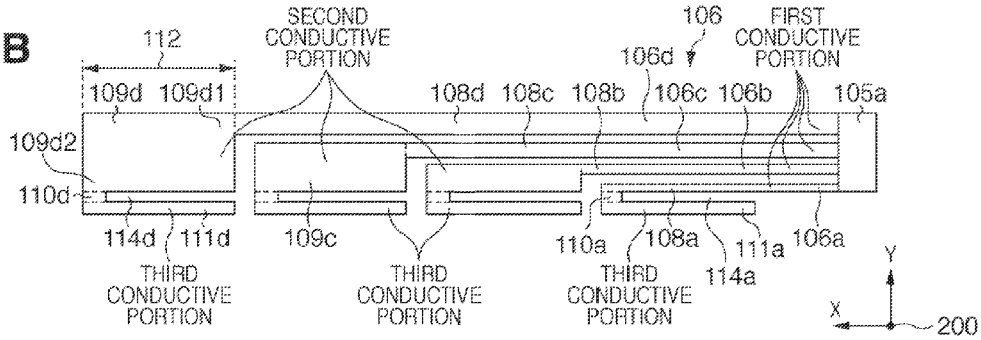
Figure 2C:
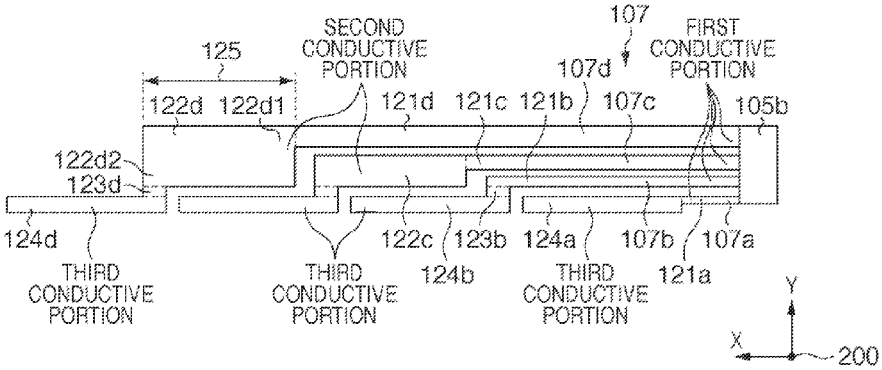

The wiring layout of the semiconductor device 100 in the embodiment will be exemplified with reference to FIGS. 2A to 2C. As shown in FIG. 2A, in the semiconductor device 100, wiring layers are formed using a multilayer wiring technique on a silicon semiconductor substrate on which elements are formed using a semiconductor device manufacturing technique. In the embodiment, for example, both the VH line 106 and GNDH line 107 are formed by patterning a uniform-thickness aluminum wiring layer positioned in the second layer. The VH line 106 is formed over an area where the power transistors 102 are formed, whereas the GNDH line 107 is formed over an area where the logic circuits 103 are formed. The VH line 106 and GNDH line 107 are respectively connected to the power supply pads 105*a* and 105*b* positioned outside (for example, on the right side) the area where the power transistors 102 are formed and the area where the logic circuits 103 are formed. In the example shown in FIG. 2A, the semiconductor device 100 has four segments aligned horizontally. These segments are denoted by 104*a*, 104*b*, 104*c*, and 104*d* sequentially from one closest to the power supply pads 105*a* and 105*b*.

The detailed shape of the VH line 106 will be explained with reference to FIG. 2B. FIG. 2B is a view which pays attention to the VH line 106 and power supply pad 105*a* shown in FIG. 2A. The VH line 106 can include four independent conductive patterns 106*a* to 106*d*. One end of each of the conductive patterns 106*a* to 106*d* is connected to the power supply pad 105*a*, and the other end is connected to one of the corresponding segments 104*a* to 104*d*. The conductive pattern 106*a* supplies power to the segment 104*a*, and the conductive pattern 106*b* supplies power to the segment 104*b*. The same goes for the conductive patterns 106*c* and 106*d*. Although the shape of the conductive pattern 106*d* will be explained in more detail, the conductive patterns 106*b* and 106*c* also have the same shape. The shape of the conductive pattern 106*a* will be described separately. For descriptive convenience, a coordinate system 200 within a plane including the VH line 106 is defined by setting the x-axis in a direction (first direction) in which the segments 104*a* to 104*d* are aligned, and the y-axis in a direction (second direction) perpendicular to the x-axis. In FIG. 2B, the left direction along the x-axis serves as a positive direction, and the upward direction along the y-axis serves as a positive direction.

The conductive pattern 106*d* can be divided into a first conductive portion 108*d*, second conductive portion 109*d*, connection portion 110*d*, and third conductive portion 111*d* sequentially from a portion close to the power supply pad 105*a*. This division is merely explanatory. The conductive pattern 106*d* need not be formed by coupling different metal plates, and may be formed by patterning a single wiring layer. The first conductive portion 108*d* can be connected to the power supply pad 105*a*, and elongate from the power supply pad 105*a* in the positive direction along the x-axis. In the example of the semiconductor device 100, the length of the first conductive portion 108*d* in the y direction is constant regardless of the x position. The second conductive portion 109*d* can have a rectangular shape (rectangle in the example of the semiconductor device 100) longer in the x direction than in the y direction, and elongate along the x-axis. The second conductive portion 109*d* can be connected, at its upper right corner 109*d*1 (first corner) in FIG. 2B, to an end of the first conductive portion 108*d* on the left side in the x direction, that is, an end opposite to one connected to the power supply pad 105*a*. The second conductive portion 109*d* is connected to the connection portion 110*d* at its lower left corner 109*d*2 (second corner) in FIG. 2B diagonal to the corner 109*d*1. The upper right corner 109*d*1 in FIG. 2B is one of the four corners of the second rectangular conductive portion 109*d* that is closest to the power supply pad 105*a* and farthest from the third conductive portion 111*d* as well as from the heater 101. The lower left corner 109*d*2 in FIG. 2B is one of the four corners of the second rectangular conductive portion 109*d* that is farthest from the power supply pad 105*a* and closest to the third conductive portion 111*d* as well as from the heater 101.

The connection portion 110*d* can be rectangular. The connection portion 110*d* can be connected to the second conductive portion 109*d* on the upper side in the y direction, that is, a side far from the heater 101, and connected to the third conductive portion 111*d* on the lower side in the y direction, that is, a side close to the heater 101. The third conductive portion 111*d* can be connected to the connection portion 110*d*, and elongate from the connected portion in the negative direction along the x-axis, that is, a direction toward the power supply pad 105*a*. As shown in FIG. 2A, the third conductive portion 111*d* can be connected to each heater 101 in the segment 104*d*. In the conductive pattern 106*d*, the length of the second conductive portion 109*d* in the y direction may be larger than that of the first conductive portion 108*d* in the y direction. Also in the conductive pattern 106*d*, the length 112 of the second conductive portion 109*d* in the x direction may be equal to the length 113 of the segment 104*d* in the x direction. In addition or instead, the length 112 of the third conductive portion 111*d* in the x direction may be equal to the length 113 of the segment 104*d* in the x direction. As shown in FIG. 2B, the upper side of the first conductive portion 108*d* and that of the second conductive portion 109*d* may coincide with each other at the y position. The second conductive portion 109*d* and third conductive portion 111*d* are connected via the connection portion 110*d*. Thus, a gap 114*d* having an opening on the side of the power supply pad 105*a* can be formed between the second conductive portion 109*d* and the third conductive portion 111*d*.

As shown in FIG. 2B, the conductive pattern 106*a* includes a first conductive portion 108*a*, connection portion 110*a*, and third conductive portion 111*a*, but does not include the second conductive portion. The first conductive portion 108*a* can be connected to the connection portion 110*a* at an end opposite to one connected to the power supply pad 105*a*. The connection portion 110*a* can be rectangular. The connection portion 110*a* can be connected to the first conductive portion 108*a* on a side far from the heater 101, and connected to the third conductive portion 111*a* on a side close to the heater 101. The third conductive portion 111*a* can be connected to the connection portion 110*a*, and elongate from the connected portion in the negative direction along the x-axis, that is, a direction toward the power supply pad 105*a*. As shown in FIG. 2A, the third conductive portion 111*a* can be connected to each heater 101 in the segment 104*a*. The first conductive portion 108*a* and the third conductive portion 111*a* are connected via the connection portion 110*a*. Thus, a gap 114*a* having an opening on the side of the power supply pad 105*a* can be formed between the first conductive portion 108*a* and the third conductive portion 111*a*.

Next, the relationship between the conductive patterns 106*a* to 106*d* will be explained. Although the conductive patterns 106*c* and 106*d* will be compared, the following relationship is established for two arbitrary conductive patterns of the VH line 106. The conductive pattern 106*c* supplies power to the segment 104*c* (first segment), and the conductive pattern 106*d* supplies power to the segment 104*d* (second segment) on the left side of the segment 104*c*, that is, at a position far from the power supply pad 105*a*. In this case, the length of a first conductive portion 108*c* in the x direction in the conductive pattern 106*c* can be larger than that of the first conductive portion 108*d* in the x direction in the conductive pattern 106*d*. To make the resistances of the conductive patterns 106*c* and 106*d* equal to each other or reduce the difference between them, the length of the first conductive portion 108*d* in the y direction in the conductive pattern 106*d* can be set larger than that of the first conductive portion 108*c* in the y direction in the conductive pattern 106*c*. Further, the length of the second conductive portion 109*d* in the y direction in the conductive pattern 106*d* may be set larger than that of a second conductive portion 109*c* in the y direction in the conductive pattern 106*c*. In the example of the embodiment, the second conductive portion 109*d* is arranged on the left side of the second conductive portion 109*c*. Thus, the length of the second conductive portion 109*d* in the y direction can be set larger than that of the second conductive portion 109*c* in the y direction by the interval between the second conductive portion 109*c* of the conductive pattern 106*c* and the first conductive portion 108*d* of the conductive pattern 106*d*. By arranging the second conductive portion 109*d* on the left side of the second conductive portion 109*c* in this way, a second conductive portion at a position farther from the power supply pad 105*a* can be made longer in the y direction. At the second conductive portion 109*d*, the current flows from the corner 109*d*1 to corner 109*d*2, so the resistance decreases for a larger length of the second conductive portion 109*d* in the y direction. Although the conductive pattern 106*a* does not have the second conductive portion, the above discussion applies by regarding the length of the second conductive portion in the y direction to be 0.

All the connection portions 110*a* to 110*d* may have the same shape, and all the third conductive portions 111*a* to 111*d* may have the same shape. If the shapes of the connection portions 110*a* to 110*d* and those of the third conductive portions 111*a* to 111*d* are the same between the segments 104*a* to 104*d*, variations of resistances from the connection portions 110*a* to 110*d* to the heaters 101 between the segments are canceled. When the third conductive portions 111*a* to 111*d* are connected to the conductive patterns of another wiring layer, the lengths of the third conductive portions 111*a* to 111*d* in the y direction may be adjusted to equalize the combined resistances with the connected conducive patterns per unit length in the x direction. The resistances of the conductive patterns 106*a* to 106*d* may be equal to each other. However, if the resistance varies by less than 10%, no image quality degradation occurs in terms of the printing performance of the inkjet printing apparatus.

Figure 3A:
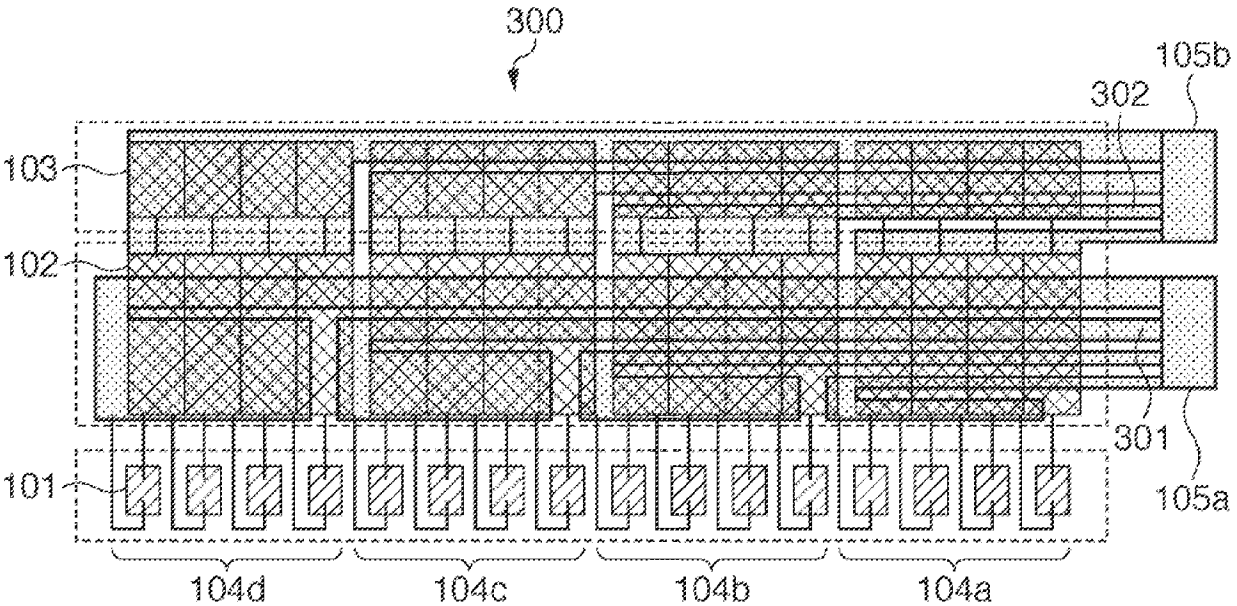
FIGS. 3A to 3C are views showing the exemplary wiring layout of a semiconductor device in a comparative example.
Figure 3B:
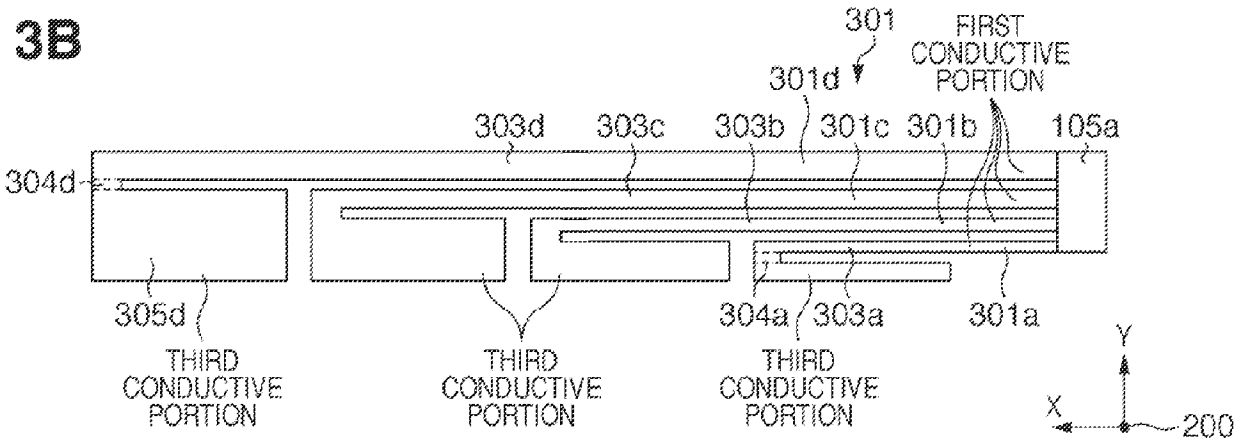
Figure 3C:
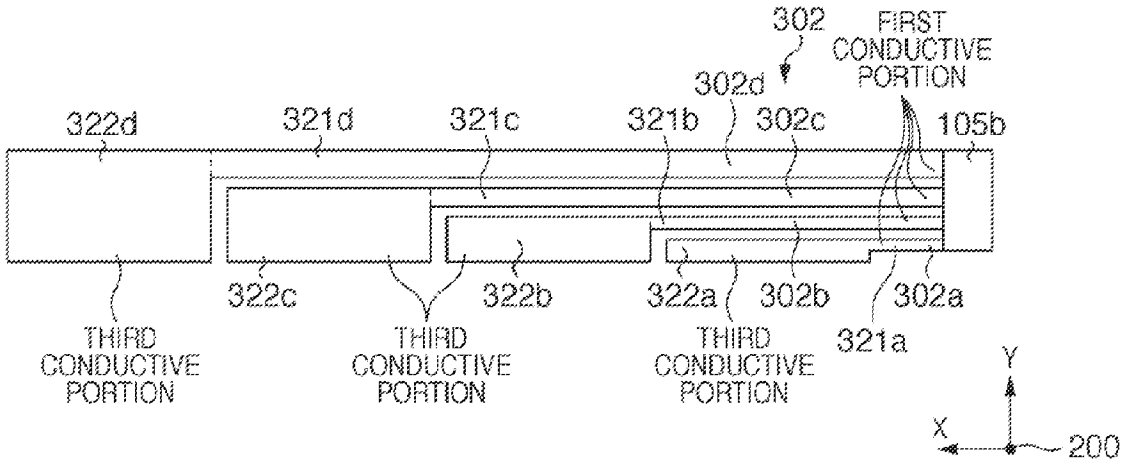
Figure 5A:
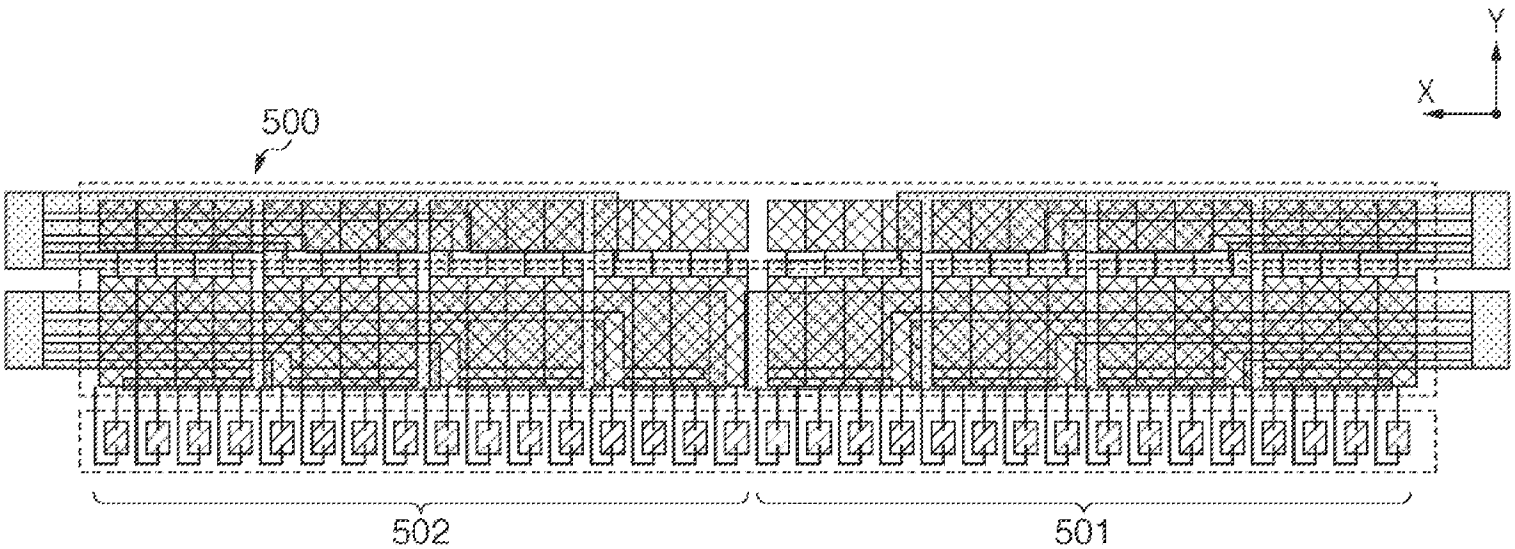
FIGS. 5A and 5B are views showing the wiring layout of an exemplary arrangement in which a plurality of semiconductor devices 100 are arranged according to the first embodiment.
Figure 5B:
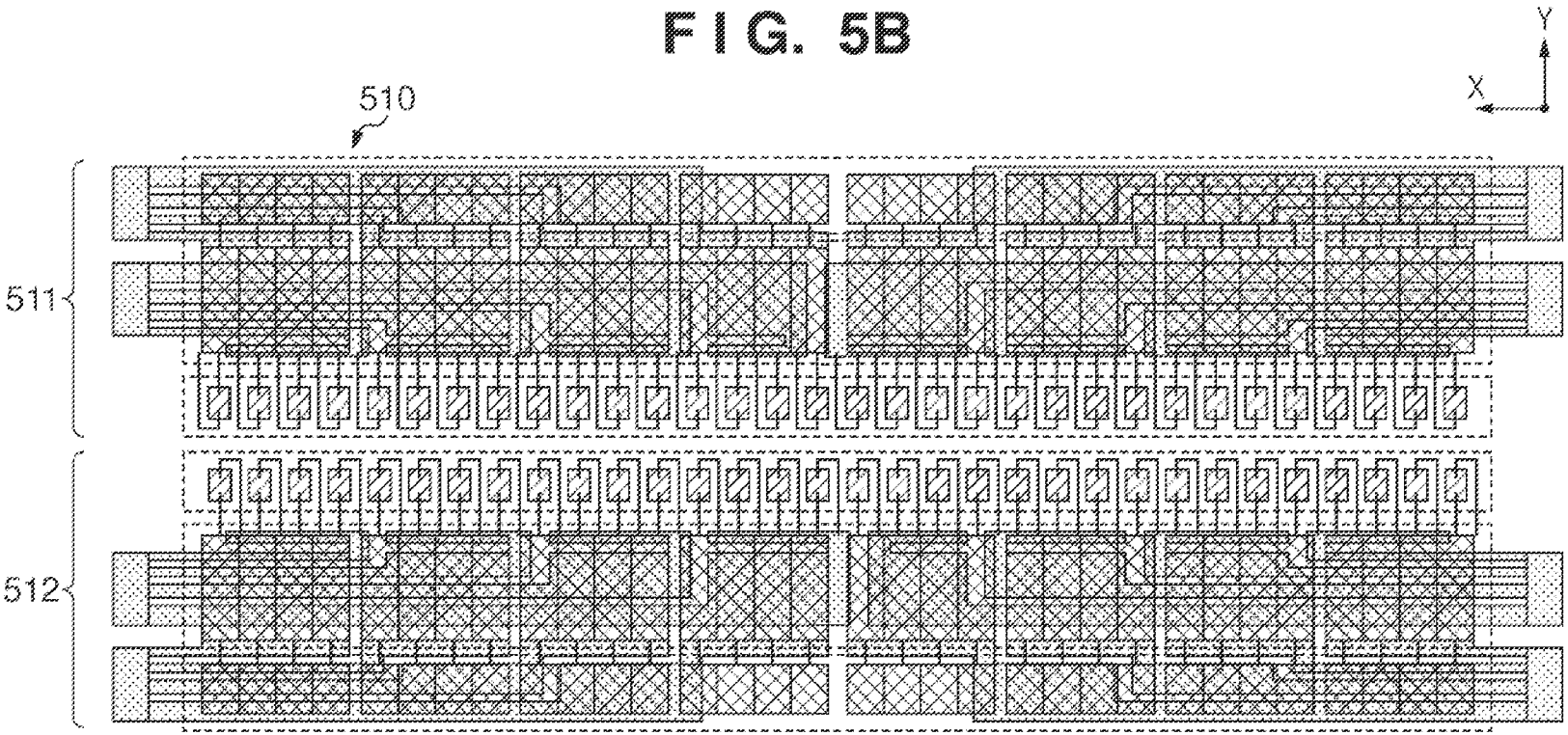

FIGS. 3A to 3C are views showing the wiring layout of a semiconductor device 300 as a comparative example for explaining the effects of the first embodiment. The semiconductor device 300 has a wiring layout expected when the wiring layout of two segments shown in FIG. 5 of Japanese Patent Laid-Open No. 2005-104142 is expanded to that of four segments. The same reference numerals as those in FIGS. 2A to 2C denote the same parts, and a description thereof will not be repeated. The semiconductor device 300 is different from the semiconductor device 100 according to the embodiment in the shapes of a VH line 301 and GNDH line 302. FIG. 3B is a view which pays attention to the VH line 301 and power supply pad 105*a*.

The VH line 301 includes four independent conductive patterns 301*a* to 301*d*. One end of each of the conductive patterns 301*a* to 301*d* is connected to the power supply pad 105*a*, and the other end is connected to one of the corresponding segments 104*a* to 104*d*.

The conductive pattern 301*d* is divided into a first conductive portion 303*d*, connection portion 304*d*, and third conductive portion 305*d* sequentially from a portion close to the power supply pad 105*a*. The first conductive portion 303*d* is connected to the power supply pad 105*a*, and elongates from the power supply pad 105*a* in the positive direction along the x-axis. The connection portion 304*d* has a rectangular shape, and connects the left end of the first conductive portion 303*d* to the upper left corner of the third conductive portion 305*d*. The third conductive portion 305*d* is connected to the lower side of the connection portion 304*d* in FIG. 3B, and elongates from the connected portion in the negative direction along the x-axis, that is, a direction toward the power supply pad 105*a*. As shown in FIG. 3A, the third conductive portion 305*d* is connected to each heater 101 in the segment 104*d*.

The result of comparing the lengths of the first conductive portions in the y direction in the conductive patterns of the VH lines in the semiconductor device 100 according to the embodiment and the semiconductor device 300 in the comparative example will be explained. As preconditions for the comparison, a distance 201 from the power supply pad 105*a* to the segment 104*a* closest to the power supply pad 105*a* is 0.5 mm, a segment pitch 202 is 1 mm, and the minimum L/S of the conductive pattern is 5 μm. The resistances of the conductive patterns extending from the power supply pad 105*a* to the connection portions 110*a* to 110*d* or 304*a* to 304*d* are equalized to each other, and the sum of the widths of the first conductive portions in the y direction in each respective conductive pattern is minimized. Table 1 shows the lengths of the first conductive portions in the y direction in the respective conductive patterns of the VH line under these preconditions. The "total wiring width" indicates the sum of the lengths of the first conductive portions in the y direction in the respective conductive patterns. For the semiconductor device 100, even the lengths of the second conductive portions 109*a* to 109*d* in the y direction are listed for reference.

TABLE 1

| Semiconductor Device 100 (Embodiment) | | | Semiconductor Device 300 (Comparative Example) | |
|---|---|---|---|---|
| | First Conductive Portion | Second Conductive Portion | | First Conductive Portion |
| Conductive Pattern 106a | 5.0 | 0.0 | Conductive Pattern 303a | 5.0 |
| Conductive Pattern 106b | 6.3 | 16.3 | Conductive Pattern 303b | 8.4 |
| Conductive Pattern 106c | 9.4 | 30.7 | Conductive Pattern 303c | 11.7 |
| Conductive Pattern 106d | 12.6 | 48.3 | Conductive Pattern 303d | 15.1 |
| Total Wiring Width | 33.3 | — | Total Wiring Width | 40.1 |

unit: μm

Table 1 reveals that the VH line 106 of the semiconductor device 100 according to the embodiment is shorter by 17% in the total length in the y direction than the VH line 301 of the semiconductor device 300 in the comparative example.

The detailed shape of the GNDH line 107 will be explained with reference to FIG. 2C. FIG. 2C is a view which pays attention to the GNDH line 107 and power supply pad 105*b* shown in FIG. 2A. The GNDH line 107 can include four independent conductive patterns 107*a* to 107*d*. One end of each of the conductive patterns 107*a* to 107*d* is connected to the power supply pad 105*b*, and the other end is connected to one of the corresponding segments 104*a* to 104*d*. The conductive pattern 107*a* supplies power to the segment 104*a*, and the conductive pattern 107*b* supplies power to the segment 104*b*. This also applies to the conductive patterns 107*c* and 107*d*. Although the shape of the conductive pattern 107*d* will be explained in more detail, the conductive pattern 107*c* also has the same shape. The shapes of the conductive patterns 107*a* and 107*b* will be described separately.

The conductive pattern 107*d* can be divided into a first conductive portion 121*d*, second conductive portion 122*d*, connection portion 123*d*, and third conductive portion 124*d* sequentially from a portion close to the power supply pad 105*b*. This division is merely explanatory. The conductive pattern 107*d* need not be formed by coupling different metal plates, and may be formed by patterning a single wiring layer. The first conductive portion 121*d* can be connected to the power supply pad 105*b*, and elongate from the power supply pad 105*b* in the positive direction along the x-axis. In the example of the semiconductor device 100, the length of the first conductive portion 121*d* in the y direction is constant regardless of the x position. The second conductive portion 122*d* can have a rectangular shape (rectangle in the example of the semiconductor device 100) longer in the x direction than in the y direction, and elongate along the x-axis. The second conductive portion 122*d* can be connected, at its upper right corner 122*d*1 (first corner) in FIG. 2C, to an end of the first conductive portion 121*d* on the left side in the x direction, that is, an end opposite to one connected to the power supply pad 105*b*. The second conductive portion 122*d* can be connected to the connection portion 123*d* at its lower left corner 122*d*2 (second corner) in FIG. 2C diagonal to the corner 122*d*1. The upper right corner 122*d*1 in FIG. 2C is one of the four corners of the second rectangular conductive portion 122*d* that is closest to the power supply pad 105*b* and farthest from the third conductive portion 124*d* as well as from the power transistor 102. The lower left corner 122*d*2 in FIG. 2C is one of the four corners of the second rectangular conductive portion 122*d* that is farthest from the power supply pad 105*b* and closest to the third conductive portion 124*d* as well as from the power transistor 102.

The connection portion 123*d* can be rectangular. The connection portion 123*d* can be connected to the second conductive portion 122*d* on the upper side in the y direction, that is, a side far from the power transistor 102, and connected to the third conductive portion 124*d* on the lower side in the y direction, that is, a side close to the power transistor 102. The third conductive portion 124*d* can be connected to the connection portion 123*d*, and elongate from the connected portion in the positive direction along the x-axis, that is, the direction apart from the power supply pad 105*b*. As shown in FIG. 2A, the third conductive portion 124*d* can be connected to each power transistor 102 in the segment 104*d*. In the conductive pattern 107*d*, the length of the second conductive portion 122*d* in the y direction may be larger than that of the first conductive portion 121*d* in the y direction. Also in the conductive pattern 107*d*, the length 125 of the second conductive portion 122*d* in the x direction may be equal to the length 113 of the segment 104*d* in the x direction. In addition or instead, the length of the third conductive portion 124*d* in the x direction may be equal to the length 113 of the segment 104*d* in the x direction. As shown in FIG. 2C, the upper side of the first conductive portion 121*d* and that of the second conductive portion 122*d* may coincide with each other at the y position.

As shown in FIG. 2C, the conductive pattern 107*a* includes a first conductive portion 121*a* and third conductive portion 124*a*, but includes neither the connection portion nor the second conductive portion. The first conductive portion 121*a* can be connected to the third conductive portion 124*a* at an end opposite to one connected to the power supply pad 105*b*. The third conductive portion 124*a* can be connected to the first conductive portion 121*a*, and elongate from the connected portion in the positive direction along the x-axis, that is, the direction far from the power supply pad 105*b*. As shown in FIG. 2A, the third conductive portion 124*a* can be connected to each power transistor 102 in the segment 104*a*.

As shown in FIG. 2C, the conductive pattern 107*b* includes a first conductive portion 121*b*, connection portion 123*b*, and third conductive portion 124*b*, but does not include the second conductive portion. The first conductive portion 121*b* can be connected to the connection portion 123*b* at an end opposite to one connected to the power supply pad 105*b*. The connection portion 123*b* can be rectangular. The connection portion 123*b* can be connected to the first conductive portion 121*b* on a side far from the power transistor 102, and connected to the third conductive portion 124*b* on a side close to the power transistor 102. The third conductive portion 124*b* can be connected to the connection portion 123*b*, and elongate from the connected portion in the positive direction along the x-axis, that is, the direction far from the power supply pad 105*b*. As shown in FIG. 2A, the third conductive portion 124*b* can be connected to each power transistor 102 in the segment 104*b*.

Next, the relationship between the conductive patterns 107*a* to 107*d* will be explained. Although the conductive patterns 107*c* and 107*d* will be compared, the following relationship is established for two arbitrary conductive patterns of the GNDH line 107. The conductive pattern 107*c* supplies power to the segment 104*c* (first segment), and the conductive pattern 107*d* supplies power to the segment 104*d* (second segment) on the left side of the segment 104*c*, that is, at a position far from the power supply pad 105*b*. In this case, the length of a first conductive portion 121*c* in the x direction in the conductive pattern 107*c* can be larger than that of the first conductive portion 121*d* in the x direction in the conductive pattern 107*d*. To make the resistances of the conductive patterns 107*c* and 107*d* equal to each other or reduce the difference between them, the length of the first conductive portion 121*d* in the y direction in the conductive pattern 107*d* can be set larger than that of the first conductive portion 121*c* in the y direction in the conductive pattern 107*c*. In addition, the length of the second conductive portion 122*d* in the y direction in the conductive pattern 107*d* may be set larger than that of a second conductive portion 122*c* in the y direction in the conductive pattern 107*c*. In the example of the embodiment, the second conductive portion 122*d* is arranged on the left side of the second conductive portion 122*c*. Hence, the length of the second conductive portion 122*d* in the y direction can be set larger than that of the second conductive portion 122*c* in the y direction by the interval between the second conductive portion 122*c* of the conductive pattern 107*c* and the first conductive portion 121*d* of the conductive pattern 107*d*. By arranging the second conductive portion 122*d* on the left side of the second conductive portion 122*c* in this way, a second conductive portion at a position farther from the power supply pad 105*b* can be made longer in the y direction. At the second conductive portion 122*d*, the current flows from the corner 122*d*1 to the corner 122*d*2, and thus the resistance decreases for a larger length of the second conductive portion 122*d* in the y direction. Although the conductive pattern 107*b* does not have the second conductive portion, the above discussion applies by regarding the length of the second conductive portion in the y direction to be 0.

All the connection portions 123*b* to 123*d* may have the same shape, and all the third conductive portions 124*a* to 124*d* may have the same shape. If the shapes of the connection portions 123*b* to 123*d* and those of the third conductive portions 124*b* to 124*d* are the same between the segments 104*b* to 104*d*, variations of resistances from the connection portions 123*b* to 123*d* to the power transistors 102 between the segments are canceled. As for the conductive pattern 107*a*, the difference in resistance from the remaining conductive patterns 107*b* to 107*d*, which arises from the absence of the connection portion, may be adjusted by the length of the first conductive portion 121*a* in the x direction. When the third conductive portions 124*a* to 124*d* are connected to the conductive patterns of another wiring layer, the lengths of the third conductive portions 124*a* to 124*d* in the y direction may be adjusted to equalize the combined resistances with the connected conducive patterns per unit length in the x direction. The resistances of the conductive patterns 107*a* to 107*d* may be equal to each other. However, if the resistance varies by less than 10%, no image quality degradation arises in terms of the printing performance of the inkjet printing apparatus.

FIG. 3C is a view which pays attention to the GNDH line 302 and power supply pad 105*b*. The GNDH line 302 includes four independent conductive patterns 302*a* to 302*d*. One end of each of the conductive patterns 302*a* to 302*d* is connected to the power supply pad 105*b*, and the other end is connected to one of the corresponding segments 104*a* to 104*d*.

The conductive pattern 302*d* is divided into first conductive portion 321*d* and third conductive portion 322*d* sequentially from a portion close to the power supply pad 105*b*. The first conductive portion 321*d* is connected to the power supply pad 105*b*, and elongates from the power supply pad 105*b* in the positive direction along the x-axis. The third conductive portion 322*d* is connected to the first conductive portion 321*d*, and elongates from the connected portion in the positive direction along the x-axis, that is, a direction apart from the power supply pad 105*b*. As shown in FIG. 3A, the third conductive portion 322*d* is connected to each power transistor 102 in the segment 104*d*.

The result of comparing the lengths of the first conductive portions in the y direction in the conductive patterns of the GNDH lines in the semiconductor device 100 according to the embodiment and the semiconductor device 300 in the comparative example will be explained. Preconditions for the comparison are the same as those for the comparison regarding the VH line, and a description thereof will not be repeated. Table 2 shows the lengths of the first conductive portions in the y direction in the respective conductive patterns of the GNDH line under these preconditions. The "total wiring width" indicates the sum of the lengths of the first conductive portions in the y direction in the respective conductive patterns. For the semiconductor device 100, even the lengths of the second conductive portions 122*a* to 122*d* in the y direction are listed for reference.

TABLE 2

| Semiconductor Device 100 (Embodiment) | | | Semiconductor Device 300 (Comparative Example) | |
|---|---|---|---|---|
| | First Conductive Portion | Second Conductive Portion | | First Conductive Portion |
| Conductive Pattern 107a | 5.0 | 0.0 | Conductive Pattern 321a | 5.0 |
| Conductive Pattern 107b | 15.1 | 0.0 | Conductive Pattern 321b | 15.1 |
| Conductive Pattern 107c | 19.5 | 44.5 | Conductive Pattern 321c | 25.1 |
| Conductive Pattern 107d | 28.8 | 78.4 | Conductive Pattern 321d | 35.2 |
| Total Wiring Width | 68.4 | — | Total Wiring Width | 80.3 |

unit: μm

Table 2 reveals that the GNDH line 107 of the semiconductor device 100 according to the embodiment is shorter by 15% in the total length in the y direction than the GNDH line 302 of the semiconductor device 300 in the comparative example.

As shown in FIG. 2A, in the semiconductor device 100, the VH line 106 is connected on the left side of a segment in the x direction, and the GNDH line 107 is connected to its right side in the x direction to reduce the difference between line resistances at heaters in the segment. However, the arrangement may be reversed in another embodiment. More specifically, the VH line may have the shape of the GNDH line 107, and the GNDH line may have that of the VH line 106.

As described above, arranging the second conductive portions in the VH line 106 and GNDH line 107 can suppress variations of line resistances to the respective segments, and decrease the total length of the conductive pattern in the y direction. This can implement a compact semiconductor device 100, increase the number of chips formable from one wafer, and thus reduce the manufacturing cost per chip.

Figure 4A:
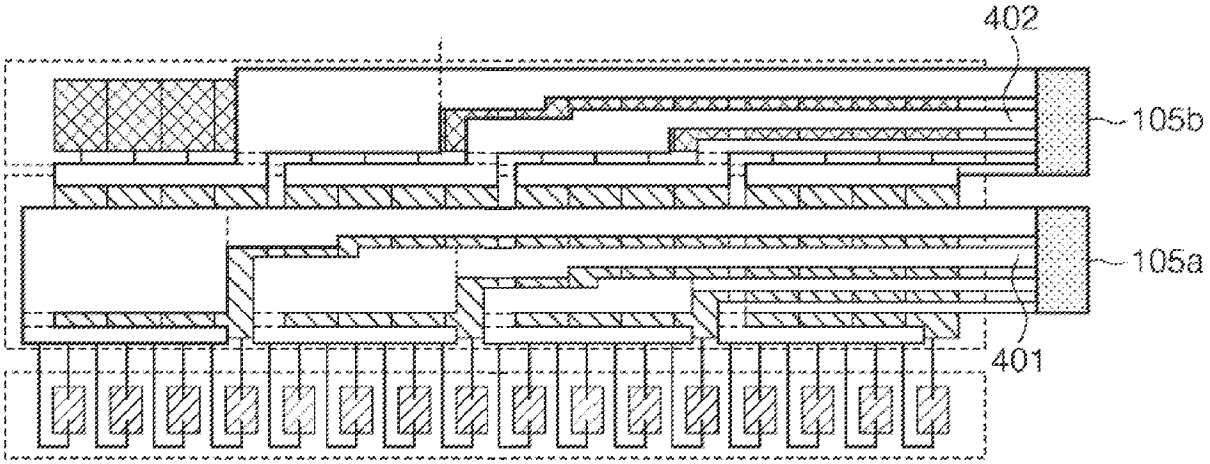
FIGS. 4A and 4B are views showing the wiring layout of a modification of the semiconductor device 100 according to the first embodiment.
Figure 4B:
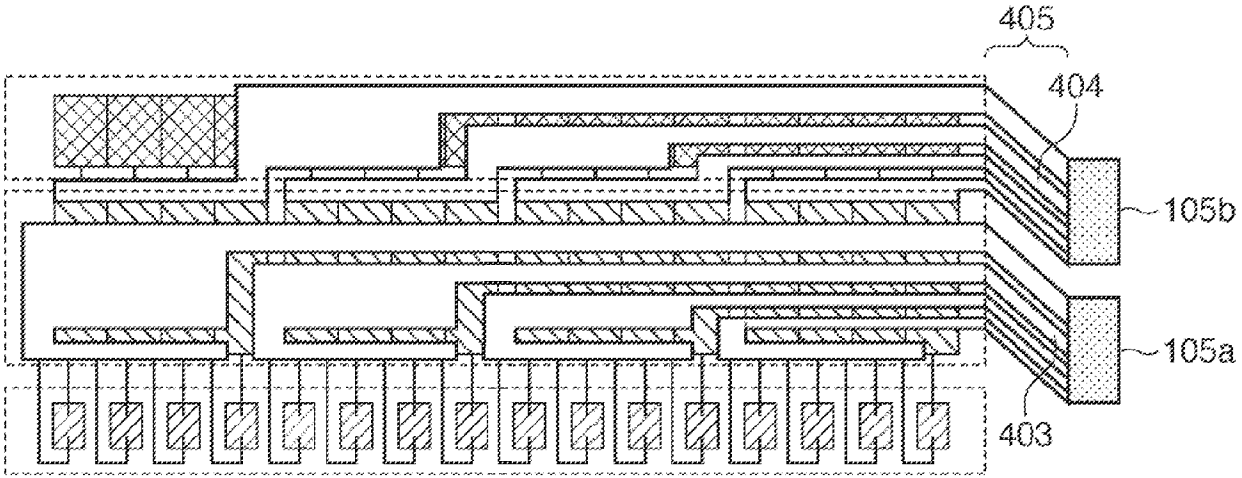

In the above-described embodiment, the second conductive portions are arranged in both the VH line 106 and GNDH line 107. Even when the second conductive portion is arranged in either one, a semiconductor device smaller in dimensions than the conventional semiconductor device 300 can be implemented. The conductive portions and connection portion need not be rectangles, and may have fillets or be rounded. For example, the conductive portions may have stepwise shapes, like a VH line 401 and GNDH line 402 shown in FIG. 4A. Although not shown, the conductive portions may be parallelograms or the like, or a combination of a plurality of shapes. Also, the first conductive portion may be bent in an area 405 near the power supply pads 105*a* and 105*b*, like a VH line 403 and GNDH line 404 shown in FIG. 4B.

In the semiconductor device 100, the number of segments is four, and the number of heaters 101 in one segment is four. However, increasing the number of segments to increase the total number of heaters leads to higher printing speed and higher printing precision. When the number of segments increase, the numbers of VH lines and GNDH lines also increase to enlarge the wiring area, which further enhance the effects of the embodiment. Alternatively, two semiconductor devices 100 may be arranged side by side in the x direction, like a semiconductor device 500 shown in FIG. 5A. In this case, semiconductor devices 501 and 502 are symmetrical about the y-axis. Further, two semiconductor devices 500 may be arranged in the y direction, like a semiconductor device 510 shown in FIG. 5B. In this case, semiconductor devices 511 and 512 are symmetrical about the x-axis.

Other Embodiments

Figure 6A:
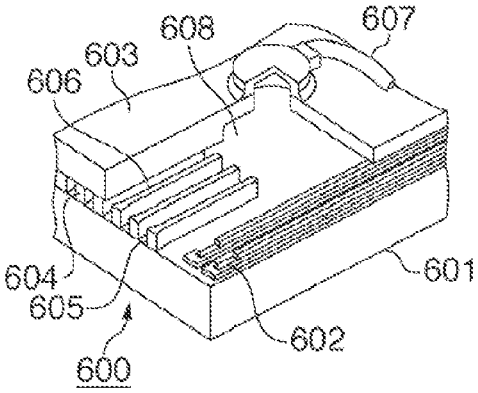
FIGS. 6A to 6D are views for explaining another embodiment.

As another embodiment, a liquid discharge head, liquid discharge cartridge, and liquid discharge apparatus using a semiconductor device 100 described in the first embodiment will be described with reference to FIGS. 6A to 6D. FIG. 6A shows, as an example of the liquid discharge head, the substrate of a printhead 600 having the semiconductor device 100 described in the first embodiment as a base 601. FIG. 6A shows the heater 101 in the first embodiment as a heat generating unit 602. For descriptive convenience, part of a top plate 603 is cut away. As shown in FIG. 6A, fluid channel wall members 606 for forming fluid channels 605 communicating with a plurality of orifices 604, and the top plate 603 having an ink supply port 607 are combined with the base 601, forming the printhead 600. In this case, ink injected through the ink supply port 607 is stored in an internal common ink chamber 608 and then supplied to each fluid channel 605. In this state, the base 601 is driven to discharge ink from the orifice 604.

Figure 6B:
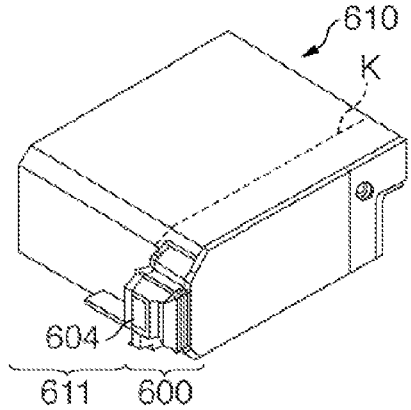

FIG. 6B is a view for explaining the whole arrangement of an inkjet cartridge 610 as an example of the liquid discharge cartridge. The cartridge 610 includes the printhead 600 having the plurality of orifices 604, and an ink tank 611 which stores ink to be supplied to the printhead 600. The ink tank 611 serving as a liquid tank is detachable from the printhead 600 at a boundary K. The cartridge 610 has an electrical contact (not shown) for receiving a driving signal from the carriage side when it is mounted in a printing apparatus shown in FIG. 6C. In accordance with the driving signal, the heat generating unit 602 is driven. The ink tank 611 incorporates a fibrous or porous ink absorber for holding ink. The ink absorber holds ink.

Figure 6C:
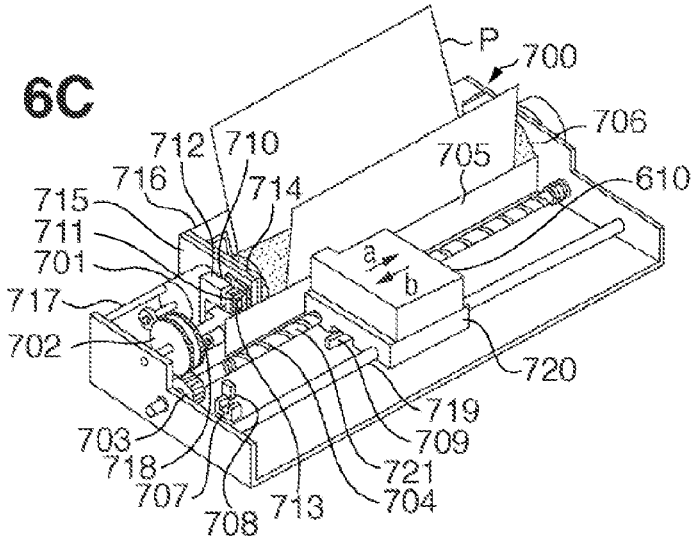

FIG. 6C is a perspective view showing the outer appearance of an inkjet printing apparatus 700 as an example of the liquid discharge apparatus. The inkjet printing apparatus 700 includes the cartridge 610, and can implement high-speed printing and high-quality printing by controlling a signal supplied to the cartridge 610. In the inkjet printing apparatus 700, the cartridge 610 is mounted on a carriage 720 which engages with a helical groove 721 of a lead screw 704 which rotates via driving force transfer gears 702 and 703 in synchronization with clockwise/counterclockwise rotation of a driving motor 701. By the driving force of the driving motor 701, the cartridge 610 can reciprocate in directions indicated by arrows a and b along a guide 719 together with the carriage 720. A paper press plate 705 for printing paper P conveyed on a platen 706 by a printing medium feeder (not shown) presses the printing paper P against the platen 706 in the carriage moving direction. Photocouplers 707 and 708 confirm the presence of a lever 709 attached to the carriage 720 in the area where the photocouplers 707 and 708 are arranged, and detect the home position to perform switching of the rotational direction of the driving motor 701 and the like. A support member 710 supports a capping member 711 for capping the entire surface of the cartridge 610. A suction portion 712 sucks the interior of the capping member 711 to execute suction recovery of the cartridge 610 via a cap opening. A moving member 715 allows moving a cleaning blade 714 back and forth. A main body support plate 716 supports the cleaning blade 714 and moving member 715. The cleaning blade 714 is not limited to the form shown in FIG. 6C, and a well-known cleaning blade is applicable to even the embodiment. A lever 717 is arranged to start suction of suction recovery. The lever 717 moves along with movement of a cam 718 engaged with the carriage 720, and its movement is controlled by a known transfer method such as clutch switching in accordance with a driving force from the driving motor 701. The apparatus main body includes a printing control unit (not shown) which supplies a signal to the heat generating unit 602 of the cartridge 610 and controls driving of each mechanism such as the driving motor 701.

Figure 6D:
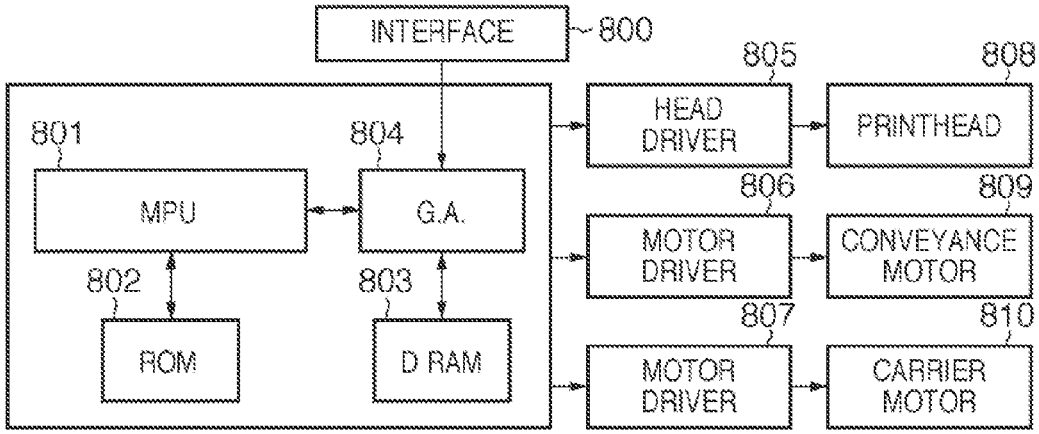

The arrangement of a control circuit for executing printing control of the inkjet printing apparatus 700 will be explained with reference to a block diagram shown in FIG. 6D. The control circuit includes an interface 800 which receives a print signal, an MPU (microprocessor) 801, and a program ROM 802 which stores a control program to be executed by the MPU 801. The control circuit also includes a dynamic RAM (Random Access Memory) 803 for saving various data (for example, the print signal and print data to be supplied to the head), and a gate array 804 which controls supply of print data to a printhead 808. The gate array 804 also controls data transfer between the interface 800, the MPU 801, and the RAM 803. Further, the control circuit includes a carrier motor 810 for conveying the printhead 808, and a conveyance motor 809 for conveying printing paper. In addition, the control circuit includes a head driver 805 for driving the printhead 808, and motor drivers 806 and 807 for driving the conveyance motor 809 and carrier motor 810, respectively. The operation of the control arrangement will be explained. When a print signal is input to the interface 800, it is converted into print data for printing between the gate array 804 and the MPU 801. Then, the motor drivers 806 and 807 are driven. At the same time, the printhead is driven in accordance with the print data sent to the head driver 805, thereby printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-123302, filed May 28, 2010 which is hereby incorporated by reference herein in its entirety.

What is claimed is:

1. A semiconductor device in which a plurality of segments are arranged on a semiconductor substrate, each segment including a plurality of driving units for discharging a liquid in nozzles, each driving unit including a driving circuit and an element which is driven by the driving circuit to apply, to the liquid, energy for discharging the liquid in the nozzle, wherein the semiconductor device includes an input pad and a plurality of conductive patterns electrically connected to the input pad, each of the conductive patterns includes a first conductive portion which is connected to the input pad and is elongated in a first direction, a second conductive portion which is elongated in the first direction, a third conductive portion which is connected to one of the plurality of driving units, and a connection portion which connects the second conductive portion and the third conductive portion, a dimension of each of the second conductive portions in a second direction perpendicular to the first direction is greater than a dimension of a corresponding one of the first conductive portions in the second direction, each of the second conductive portions is connected to the corresponding one of the first conductive portions at a side nearer to the input pad than a center line of the second conductive portion in the first direction, and connected to a corresponding one of the connection portions at a side farther from the input pad than the center line, and each of the third conductive portions is elongated from a portion connected to the corresponding one of the connection portions in the first direction.

2. The device according to claim 1, wherein each of the third conductive portions is elongated from a portion connected to a corresponding one of the connection portions in the first direction towards the input pad.

3. The device according to claim 2, wherein the input pad is configured to receive a power supply voltage.

4. The device according to claim 1, wherein each of the third conductive portions is elongated from a portion connected to the corresponding one of the connection portions in the first direction away from the input pad.

5. The device according to claim 4, wherein the input pad is configured to receive a ground voltage.

6. The device according to claim 1, wherein a region of each of the second conductive portions closest to the input pad and farthest from a corresponding one of the third conductive portions is connected to a corresponding one of the first conductive portions.

7. The device according to claim 1, wherein the plurality of segments includes a first segment and a second segment at a position farther from the input pad than the first segment, a dimension of the first conductive portion in the second direction in one of the conductive patterns connected to the first segment is greater than a dimension of the first conductive portion in the second direction in another of the conductive patterns connected to the second segment, and a dimension of the second conductive portion in the second direction in the conductive pattern connected to the first segment is greater than a dimension of the second conductive portion in the second direction in the conductive pattern connected to the second segment.

8. The device according to claim 1, wherein resistances of the plurality of conductive patterns are equal to each other.

9. The device according to claim 1, wherein dimensions of the third conductive portions in the second direction in the plurality of conductive patterns are equal to each other.

10. The device according to claim 1, wherein a dimension of one of the segments in the first direction connected to a corresponding one of the conductive patterns is equal to a dimension of the second conductive portions in the first direction in the one conductive pattern.

11. The device according to claim 1, wherein the plurality of conductive patterns overlap with the driving circuit in a planar view.

12. A liquid discharge head comprising:

the semiconductor device according to claim 1, and the nozzles, wherein discharge of a liquid from the nozzles is controlled by the semiconductor device.

13. A liquid discharge cartridge comprising:

the liquid discharge head according to claim 12, and a liquid tank which stores the liquid.

14. A liquid discharge apparatus comprising:

the liquid discharge head according to claim 12, and a supply unit configured to supply a driving signal for discharging the liquid to the liquid discharge head.

15. A semiconductor device in which a plurality of segments are arranged on a semiconductor substrate, each segment including a plurality of driving units for discharging a liquid in nozzles, each driving unit including a driving circuit and an element which is driven by the driving circuit to apply, to the liquid, energy for discharging the liquid in the nozzle, wherein the semiconductor device includes a first input pad, a second input pad, a plurality of first conductive patterns electrically connected to the first input pad, and a plurality of second conductive patterns electrically connected to the second input pad, each of the first and second conductive patterns includes a first conductive portion which is connected to one of the first and second input pads and is elongated in a first direction, a second conductive portion which is elongated in the first direction, a third conductive portion which is connected to one of the plurality of driving units, and a connection portion which connects the second conductive portion and the third conductive portion, a dimension of each of the second conductive portions in a second direction perpendicular to the first direction is greater than a dimension of a corresponding one of the first conductive portions in the second direction, each of the second conductive portions is connected to the corresponding one of the first conductive portions at a side nearer to one of the first and second input pads than a center line of the second conductive portion in the first direction, and connected to a corresponding one of the connection portions at a side farther from the one of the first and second input pads than the center line, the third conductive portion of the first conductive pattern is elongated from a portion connected to the connection portion in the first direction towards one of the first and second input pads, and the third conductive portion of the second conductive pattern is elongated from a portion connected to the connection portion in the first direction away from one of the first and second input pads.

16. The device according to claim 15, wherein the first input pad is configured to receive a power supply voltage and the second input pad is configured to receive a ground voltage.

17. The device according to claim 15, wherein the first and second input pads are arranged on the same side as the plurality of segments.

18. A liquid discharge head comprising:

the semiconductor device according to claim 15, and the nozzles, wherein discharge of a liquid from the nozzles is controlled by the semiconductor device.

19. A liquid discharge cartridge comprising:

the liquid discharge head according to claim 18, and a liquid tank which stores the liquid.

20. A liquid discharge apparatus comprising:

the liquid discharge head according to claim 18, and a supply unit configured to supply a driving signal for discharging the liquid to the liquid discharge head.

* * * * *